US006408844B1

(12) United States Patent
Lee

(10) Patent No.: US 6,408,844 B1
(45) Date of Patent: Jun. 25, 2002

(54) BREATHING APPARATUS

(76) Inventor: Hwa-joon Lee, 48-17, Jeonnong-3-dong, Tongdaemun-gu, Seoul (KR)

( * ) Notice: Subject to any disclaimer, the term of this patent is extended or adjusted under 35 U.S.C. 154(b) by 0 days.

(21) Appl. No.: 09/719,080

(22) PCT Filed: Apr. 28, 1999

(86) PCT No.: PCT/KR99/00203

§ 371 (c)(1),
(2), (4) Date: Dec. 7, 2000

(87) PCT Pub. No.: WO00/09391

PCT Pub. Date: Feb. 24, 2000

(30) Foreign Application Priority Data

Aug. 12, 1998 (KR) ..... 1998-15158

(51) Int. Cl.[7] ..... B63C 11/16

(52) U.S. Cl. ..... 128/201.11; 128/200.29; 128/201.27; 128/201.28; 128/202.14

(58) Field of Search ..... 128/201.11, 200.29, 128/201.27, 201.28, 202.14

(56) References Cited

U.S. PATENT DOCUMENTS 3,370,586 A * 2/1968 Aragona et al. ..... 128/201.11
4,583,536 A * 4/1986 Jan ..... 128/201.11
4,793,341 A * 12/1988 Arasmith ..... 128/201.11
5,261,396 A * 11/1993 Faulconer et al. ..... 128/201.11
5,351,681 A * 10/1994 Hudson ..... 128/201.11
5,535,734 A * 7/1996 Lu et al. ..... 128/201.27
5,606,967 A * 3/1997 Wang ..... 128/201.11
5,622,165 A * 4/1997 Huang ..... 128/201.11
5,671,728 A * 9/1997 Winefordner et al. . 128/201.11
6,119,685 A * 9/2000 Kawashima et al. ... 128/201.11
6,129,081 A * 10/2000 Wu ..... 128/201.11
6,202,644 B1 * 3/2001 Takeuchi et al. ..... 128/201.11

FOREIGN PATENT DOCUMENTS

GB 2187103 A * 9/1987

* cited by examiner

*Primary Examiner*—John G. Weiss
*Assistant Examiner*—Darwin P. Erezo
(74) *Attorney, Agent, or Firm*—Madson & Metcalf

(57) ABSTRACT

A breathing apparatus adapted for use in combination with a tube for swimming, the breathing apparatus includes a floatable body having a hollow case for floating over water level and an opening; and a breathing assembly mounted detachably. The breathing assembly has a connector inserted within the opening of the floatable body; a fixing cap mounted on the floatable body for preventing separation of the breathing assembly from the floatable body, and for providing fresh air from the outside to the breathing assembly; a mouth connecting member connected to the connector and providing air to the swimmer's mouth; an air intake check member having an inlet check valve opened only in one direction for preventing upward flow of exhausted air; and a water intake check member having an outlet check valve also opened only in one direction for discharging exhausted air and for preventing entry of water into the breathing assembly.

6 Claims, 7 Drawing Sheets

BREATHING APPARATUS

BACKGROUND OF THE INVENTION

1. Field of the Invention

This invention relates to a breathing apparatus, and more particularly to, a breathing apparatus which can provide air to a swimmer without the use of compressed air tanks so as to allow the swimmer to submerge for a long time and is adapted for use in combination with a tube for swimming.

2. Description of the Prior Art

In general, tubes used by a swimmer as means for floating above water level, and compressed air tanks and snorkels are used by a swimmer as means for remaining submerged in shallow water.

The conventional tubes which are formed in doughnut shape and made of rubber or thin vinyl contain air therein so that the swimmer can float above water level by buoyance of the tubes.

The conventional compressed air tanks and snorkels are to provide air to the swimmer submerged under water.

The tubes, the compressed air tanks, and the snorkels are separately manufactured and used according to their use.

However, since the conventional tubes are made of rubber or thin vinyl, they may burst during swimming by an external pressure.

The snorkels are used for submerging only in the limited depth during a short time. The compressed air tanks also have a disadvantage that the user can dive only during the limited period of time due to the limited air volume of the tanks. The compressed air tanks have another disadvantage that, since it is very expensive, to use it for swim is too heavy a burden in price for the public or children.

SUMMARY OF THE INVENTION

In view of the foregoing, it is accordingly, a primary object of the present invention to provide an improved breathing apparatus which enables a swimmer to remain submerged for a long time without using any air suppliers.

It is also an object of the present invention to provide a breathing apparatus which may be also used as a tube for according to the swimmer's needs.

It is a further object of the present invention to provide a breathing apparatus which is of a durable and reliable construction.

It is a still further object of the present invention to provide a breathing apparatus which has improved commodity value.

The foregoing objects are accomplished by providing an improved breathing apparatus comprising: a floatable body having a hollow case for floating over water level and an opening; and a breathing assembly mounted detachably to the floatable body, the breathing assembly including: a connector having a connecting pipe to be inserted within the opening of the floatable body and a flexible connecting hose connected to a lower end portion of the connecting pipe; a fixing cap having a plurality of holes for providing fresh air from the outside to the breathing assembly, the fixing cap being mounted on an upper central portion of the floatable body that the connecting pipe is inserted in the opening to prevent separation of the connecting pipe; a mouth connecting member connected to the connecting hose, having a mouth piece formed integrally with the mouth connecting member, and providing air to the swimmer's mouth through the mouth piece; an air intake check member arranged near the connected portion of the connecting hose and the mouth connecting member, and having an inlet check valve opened only in one direction for preventing upward flow of exhausted air; and a water intake check member arranged near the lower end portion of the mouth connecting member, and having an outlet check valve also opened only in one direction for discharging exhausted air and for preventing entry of water into the breathing assembly.

The foregoing and other objects and features of the present invention will become more fully apparent to persons of ordinary skill in the art from the following description and appended claims, taken in conjunction with the accompanying drawings.

BRIEF DESCRIPTION OF THE DRAWINGS

Understanding that these drawings depict only typical embodiments of the invention and are, therefore, not to be considered limiting of its scope, the invention will be described with additional specificity and detail through use of the accompanying drawings in which.

DETAILED DESCRIPTION OF THE PREFERRED EMBODIMENTS

Figure 1:
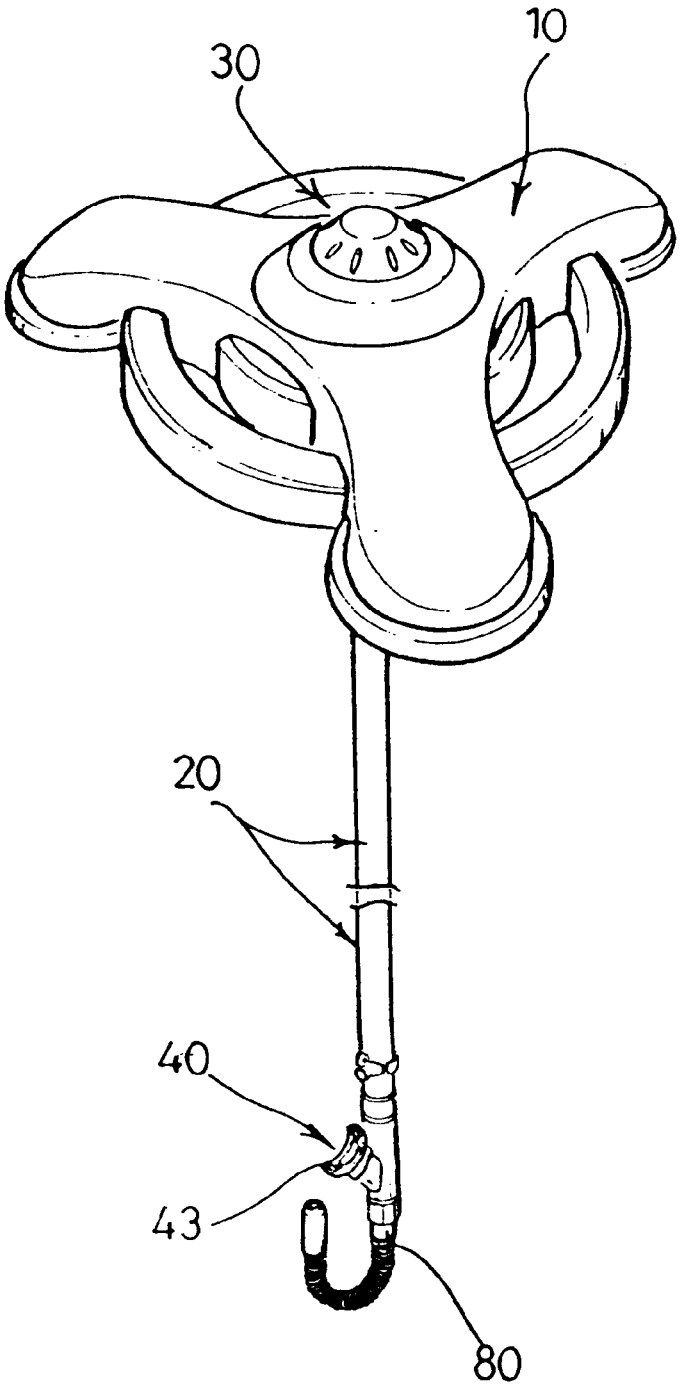
FIG. 1 is a perspective view of the present invention.

Referring now to the drawings, wherein like reference characters designate corresponding parts throughout several views, the reference numeral 10 indicates a floatable body floating above water level by its buoyancy, and having a hollow case for floating over water level by its buoyancy and an opening 11 formed at a central portion thereof.

In order to have buoyancy, the floatable body 10 may be filled with buoyant materials such as a styrene foam, or filled with air. Preferably, it is manufactured to be filled with air within a hollow case thereof, considering its weight and cost of manufacture.

The floatable body 10 according to the present invention is formed by the blow molding and has a hollow inside. The hollow inside of the floatable body 10 is filled with air and kept in the sealed state.

The floatable body 10 may have various outward shapes according to user's desires. The floatable body 10 manufactured by the above is durable and reliable from external pressure, and it alone is used as a tube for floating a swimmer during swimming in water.

The floatable body 10 can be also used as a breathing apparatus by connecting a breathing assembly according to the present invention.

The breathing assembly includes: a connector 20 having a connecting pipe 21 to be inserted within the opening 11 of the floatable body 10 and a flexible connecting hose 25 having an end portion connected to a lower end portion of the connecting pipe 21; a fixing cap 30 for providing air from the outside to the breathing assembly, the fixing cap 30 being mounted on an upper central portion of the floatable body 10 that the connecting pipe 21 is inserted in the opening 11 to prevent separation of the connecting pipe 21; a mouth connecting member 40 connected to the other end portion of the connecting hose 25 for providing fresh air to the swimmer's mouth; an air intake check member 50 arranged near the connected portion of the connecting hose 25 and the mouth connecting member 40; and a water intake check member 60 arranged near a lower end portion of the mouth connecting member 40.

Figure 3:
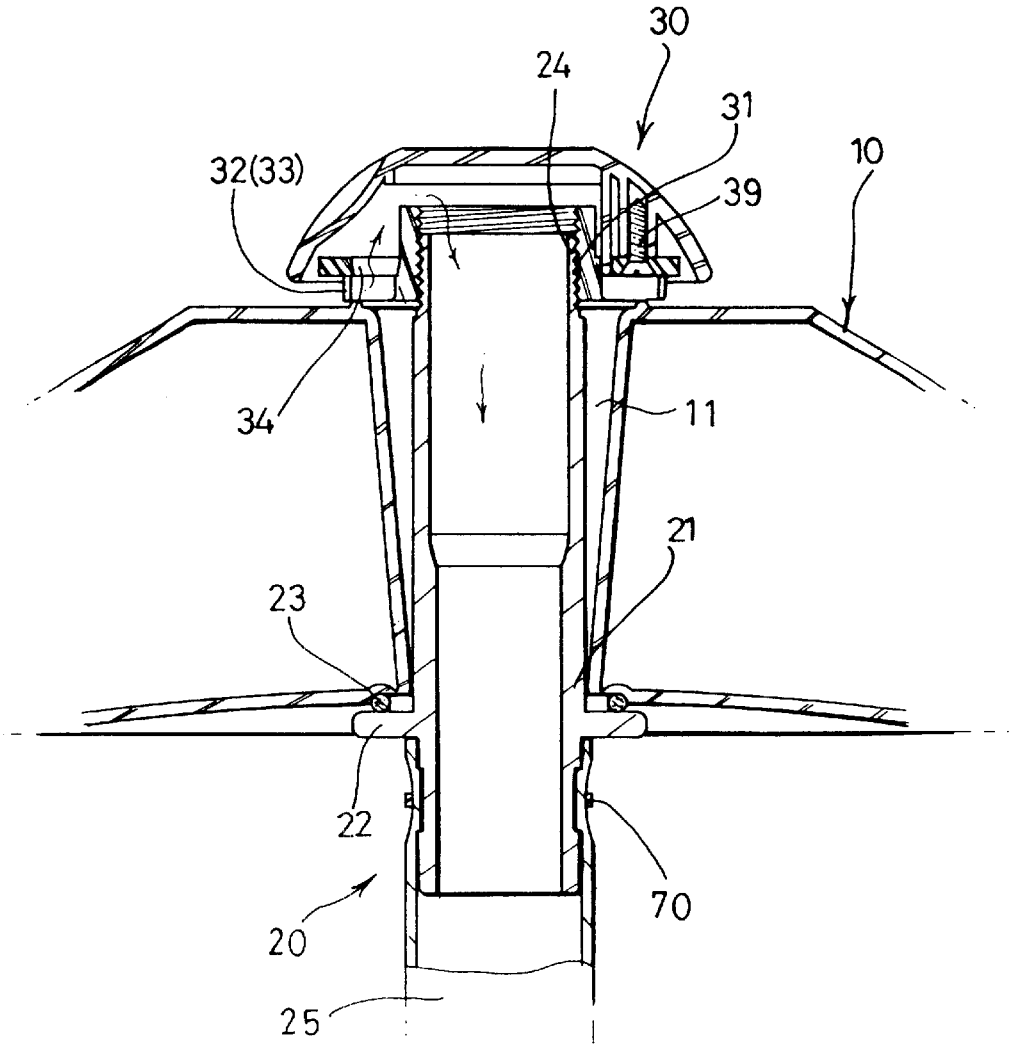
FIG. 3 is a partial enlarged sectional side view showing a state that a fixing cap is fixed to a connecting pipe.

As shown in FIG. 3, the connecting pipe 21 has a flange 22 formed integrally at the lower outer periphery thereof. The flange 22 ensures that the connecting pipe 21 inserted within the opening 11 of the floatable body 10 is closely contacted with the lower surface of the floatable body 10, so as to prevent entry of water from outside into the connecting pipe 21 through a gap between the floatable body 10 and the connecting pipe 21. In order to firmly seal, it is preferable that a O-shaped ring 23 is positioned between the lower surface of the floatable body 10 and the flange 22.

The upper portion of the connecting pipe 21 has an external screw 24 on an outer peripheral surface thereof to be screwed with an internal screw 31 of the fixing cap 30. Virtue of the external screw 24 of the connecting pipe 21 and the internal screw 31 of the fixing cap 30, the breathing assembly can be easily separated from the floatable body 10.

Figure 4:
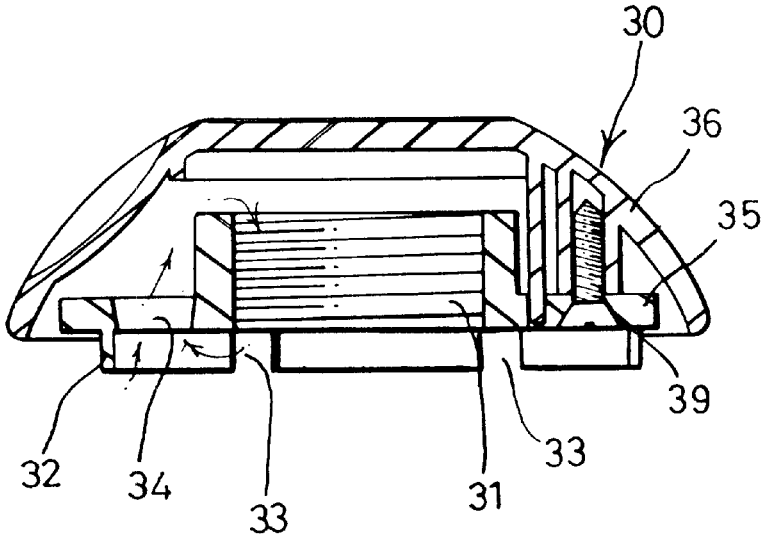
FIG. 4 is a sectional side view showing a shape of the fixing cap.
Figure 5:
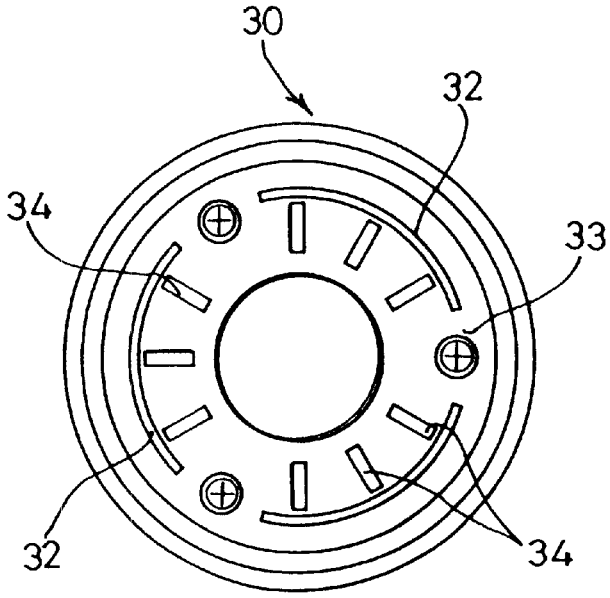
FIG. 5 is a bottom view of the fixing cap.

As shown in FIGS. 4 and 5, the fixing cap 30 has an upper member 36 and a lower member 35 which they may be separated from each other. The upper member 36 and the lower member 35 are assembled with each other by using at least one or more bolts 39. The lower member 35 of the fixing cap 30 has at least two or more protrusions 32 protruded from the lower outer surface thereof, at least two or more spaces 33 made between the protrusions 32 of the lower member 35 of the fixing cap 30 and the upper portion of the floatable body 10, and a plurality of holes 34 for providing fresh air from the outside into the breathing assembly. The spaces 33 allow the fresh air necessary for breathing of the swimmer to smoothly enter into the holes 34 from the outside.

The fresh air entered into the fixing cap 30 through the spaces 33 and the holes 34 flows into the connecting pipe 21 screwed with the fixing cap 30.

The flexible connecting hose 25 connected to the lower end portion of the connecting pipe 21 may have various length according to the swimmer's needs.

Figure 6:
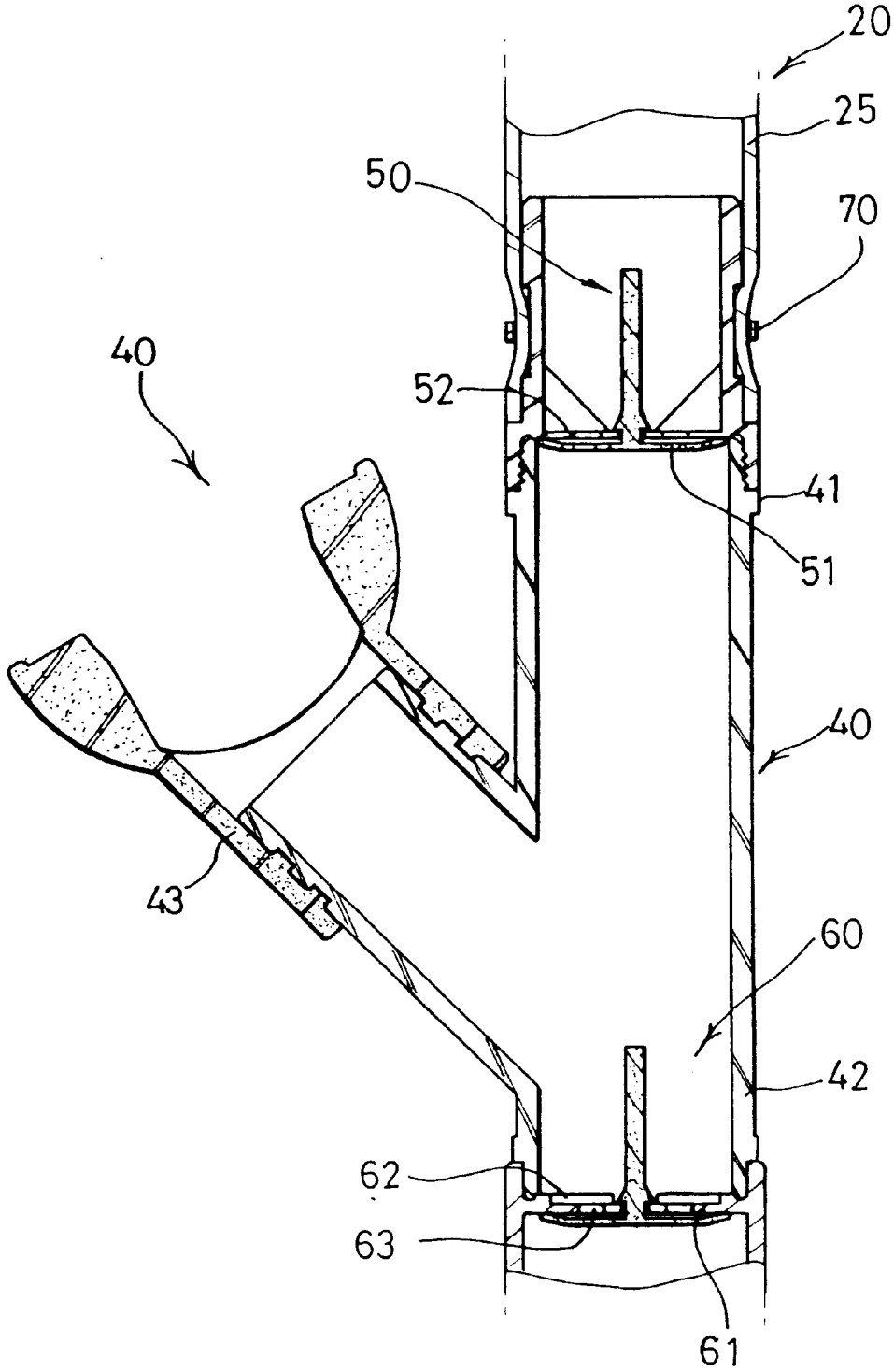
FIG. 6 is a sectional side view of a mouth connecting member.
Figure 7:
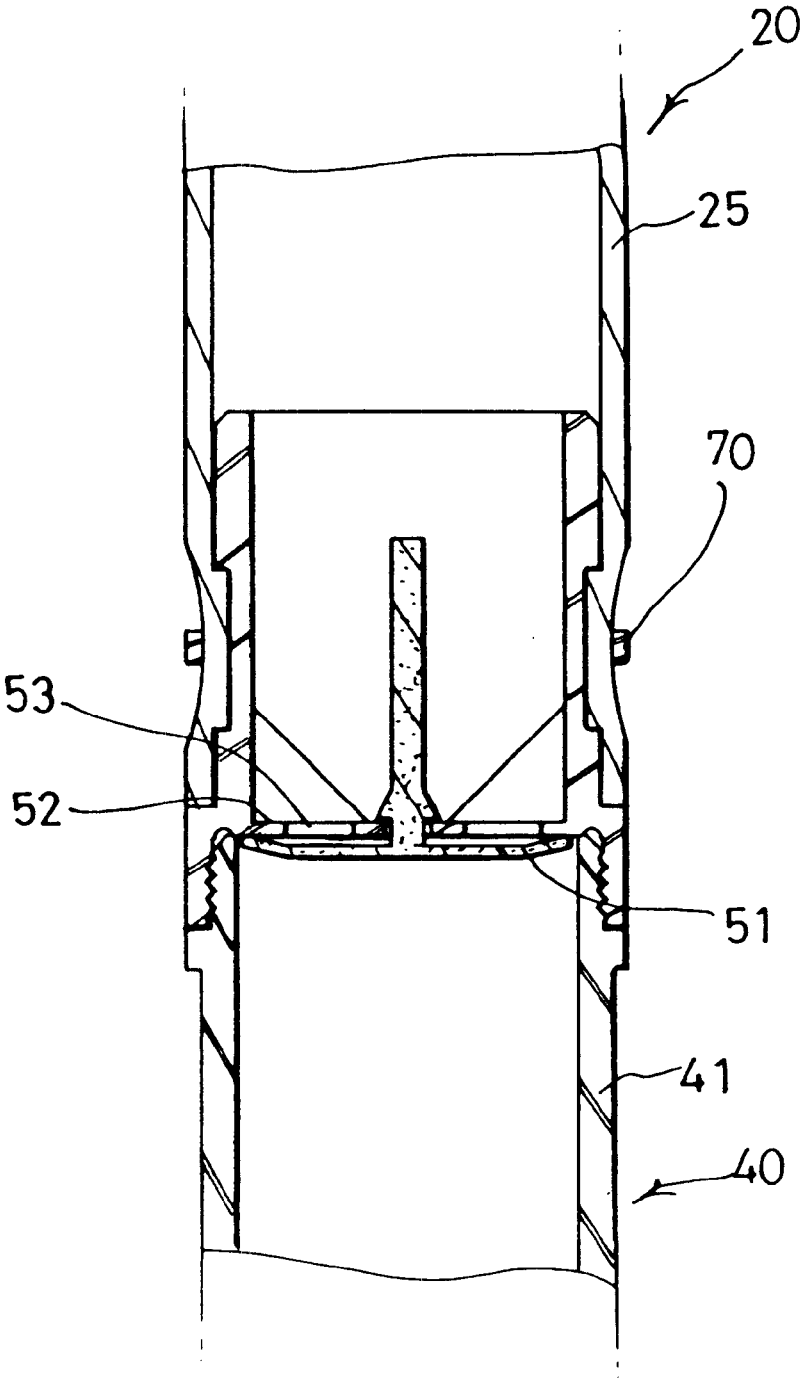
FIG. 7 is a partial enlarged sectional side view showing a mounted state of a valve which allows a one-way flow of air.
Figure 8:
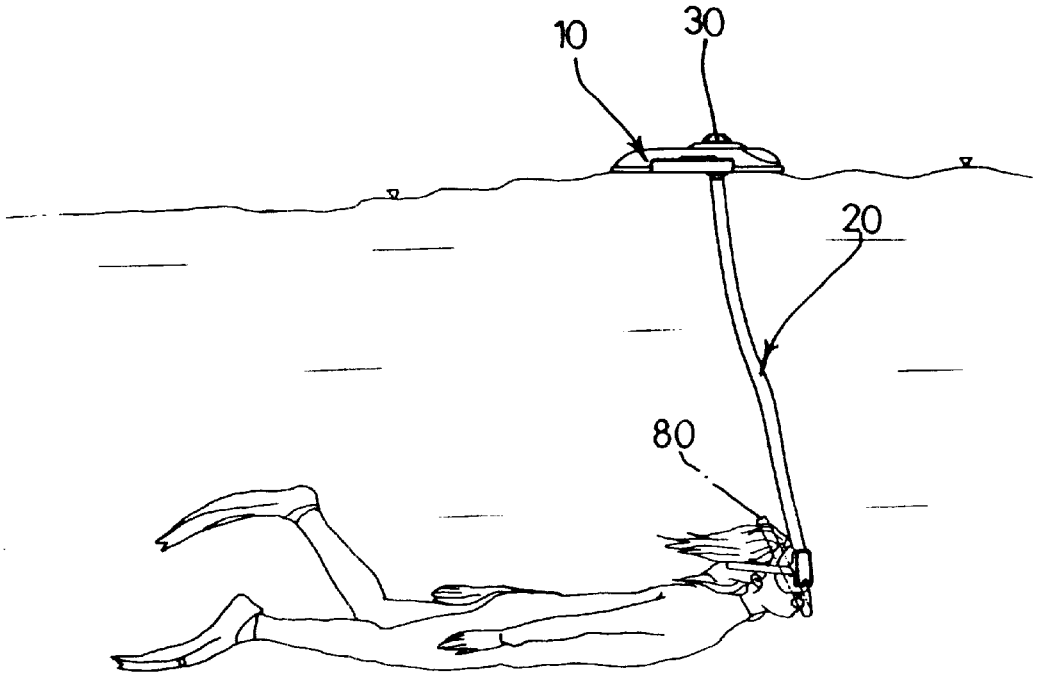
FIG. 8 is an environmental perspective view of the invention.

As shown in FIGS. 3 and 6, the flexible connecting hose 25 is connected with the connecting pipe 21 and the mouth connecting member 40 by cable ties 70 for tightly sealing the connected portions so as to prevent entry of water through the connected portions into the breathing assembly.

In FIG. 6, the mouth connecting member 40 has three-directional passages, i.e., an air entry portion 41, an air exit portion 42, and a mouth piece 43. The air entry portion 41 is disposed near the connected portion between the connecting hose 25 and the mouth connecting member 40. The air exit portion 42 is disposed between the mouth piece 43 and the lower end portion of the mouth connecting member 40 so as to discharge exhausted air and/or water outside. The air entry portion 41 and the air exit portion 42 both have unidirectional air flow so as to prevent upward flow of exhausted air.

The air intake check member 50 which is disposed at the air entry portion 41 of the mouth connecting member 40 has an inlet check valve 51 opened only in the direction of air entry to prevent upward flow of exhausted air. The water intake check member 60 which is disposed at the air exit portion 42 has an outlet check valve 61 for discharging exhausted air blown off from the mouth of the swimmer and for preventing entry of water from the outside into the mouth connecting member 40. The inlet check valve 51 and the outlet check valve 61 act conversely with each other, i.e., when the inlet check valve is opened for breathing of the swimmer, the outlet check valve 61 is shut for preventing exit of fresh air and entry of water, and when the outlet check valve 61 is opened for discharging exhausted air, the inlet check valve 51 is shut.

As shown in FIG. 6, the air entry portion 41 of the mouth connecting member 40 has a traverse bar 52 having at least one or more holes 53 which may be opened or shut by the inlet check valve 51. The air exit portion 42 also has a traverse bar 62 having at least one or more holes 63 which may be opened or shut by the outlet check valve 61.

The inlet check valve 51 and the outlet check valve 61 are both made of thin soft film. When the swimmer breathes in with the mouth piece 43 in the swimmer's mouth, the inlet check valve 51 of the thin soft film may be smoothly opened according to air flow direction. The air flown into the opened air entry portion 41 may flow into the swimmer's mouth through the mouth piece 43. At this time, the outlet check valve 61 is shut so that water cannot enter into the breathing assembly from the outside.

When the swimmer breathes out, the inlet check valve 51 is shut and the outlet check valve 61 is opened, so that exhausted air can be discharged outside.

The holes 34 of the fixing cap 30 above water level serve as an air inlet. The swimmer can breathe in and out through the breathing assembly connected with the fixing cap 30. Therefore, virtue of the present invention, the swimmer can submerge under water for a long time, breathing without any other auxiliary breathing devices.

Figure 2:
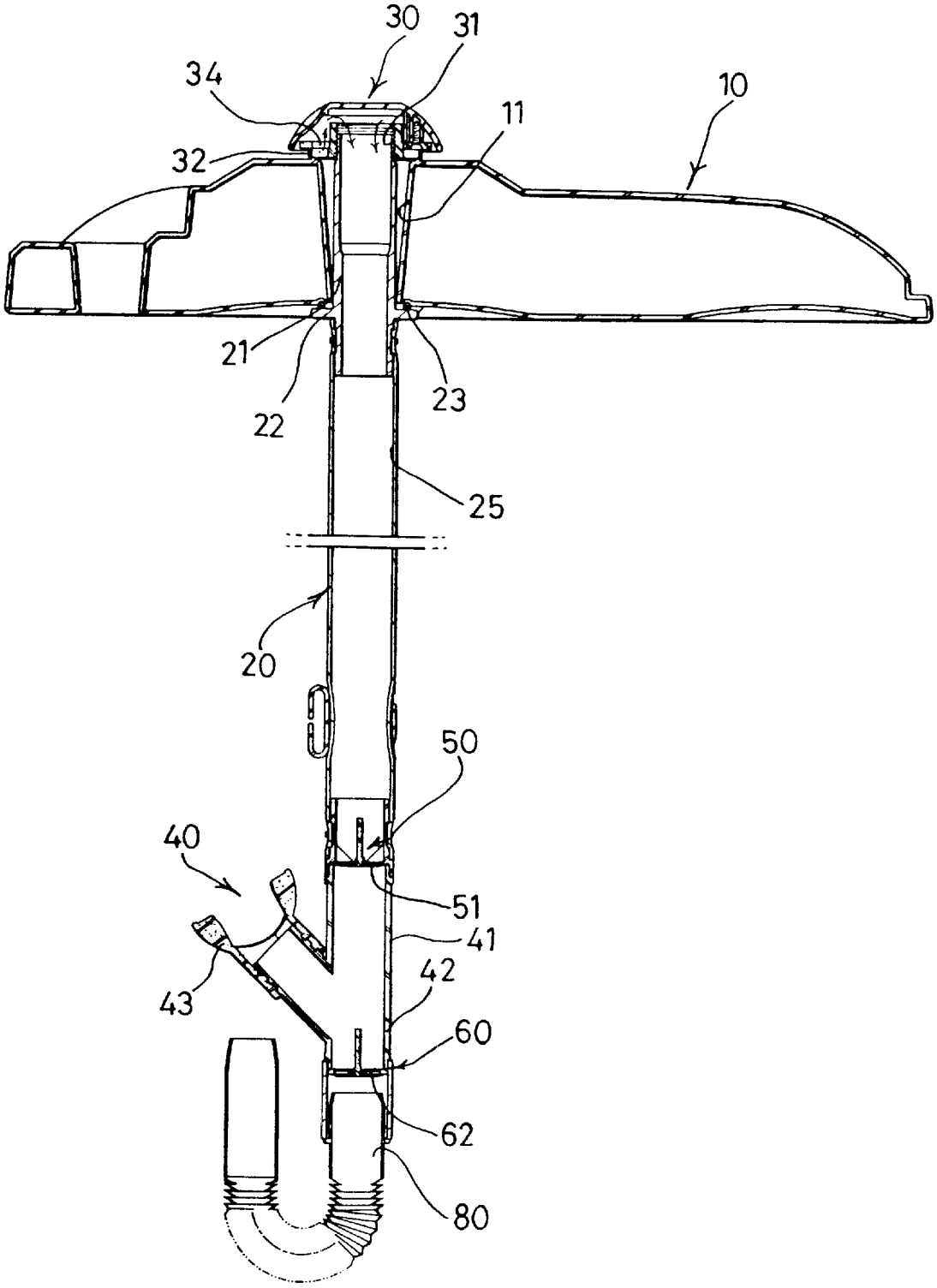
FIG. 2 is a longitudinal sectional view of the present invention.

Because the exhausted air discharged through the air exit portion 42 makes bubbles in water, the swimmer's field of vision may be obstructed by bubbles. In order to prevent the bubbles from obstructing the swimmer's field of vision, a guide pipe 80 may be connected to the lower end portion of the air exit portion 42 as shown in FIG. 2. The guide pipe 80 is a bellows type expansion pipe so that it can be bent to any directions intended by the swimmer to discharge the bubbles at the back of the swimmer.

Those skilled in the art will readily recognize that these and various other modifications and changes may be made to the present invention without strictly following the exemplary application illustrated and described herein and without departing from the true spirit and scope of the present invention, which is set forth in the following claims.

What is claimed is:

1. A breathing apparatus for use in combination with a tube for swimming, the breathing apparatus comprising:

a floatable body having a hollow case for floating over water level and an opening; and a breathing assembly for providing fresh air from the outside to a swimmer's mouth, the breathing assembly having:

a connector having a connecting pipe to be inserted within the opening of the floatable body and a flexible connecting hose having an end portion connected to a lower end portion of the connecting pipe;

a fixing cap for providing fresh air from the outside to the breathing assembly, the fixing cap being mounted on an upper central portion of the floatable body and removably attached to the connecting pipe to prevent separation of the connecting pipe from the fixing cap, wherein the fixing cap has an upper member and a lower member which may be separated from each other, the lower member of the fixing cap having at least two or more protrusions from a lower outer surface thereof in contact with the upper central portion of the floatable body, at least two or more spaces between the protrusions, and a plurality of holes, said protrusions, spaces, and holes defining a passageway to allow fresh air from the outside into the breathing assembly;

a mouth connecting member connected to the other end portion of the connecting hose, the mouth connecting member having an air entry portion positioned near the connected portion of the connecting hose and the mouth connecting member, an air exit portion positioned near a lower end portion of the mouth connecting member, and a mouth piece formed integrally with the mouth connecting member, the mouth piece positioned between the air entry portion and the air exit portion, the mouth connecting member providing air from the fixing cap to the swimmer's mouth through the mouth piece;

an air intake check member arranged at the air entry portion, the air intake check member having an inlet check valve opened only in the direction of the air entry to prevent counterflow of exhausted air;

a water intake check member arranged at the air exit portion, the water intake check member having an outlet check valve for discharging exhausted air outside and for preventing entry of water from outside into the breathing assembly, wherein the inlet check valve is opened for breathing in of the swimmer, the outlet check valve is shut for preventing upward flow of exhausted air and entry of water, and when the outlet check valve is opened for discharging exhausted air, the inlet check valve is shut; and a bendable guide hose connected to the air exit portion at the lower end portion of the mouth connecting member, wherein the guide hose is bendable by the swimmer to direct exhausted air away from the swimmer's field of vision.

2. A breathing apparatus according to claim 1, wherein the connecting pipe has an external screw on an outer peripheral surface thereof and the fixing cap has an internal screw on an inner peripheral surface of the lower member of the fixing cap, so that they are screwed with each other to tightly connect the fixing cap, the floatable body, and the breathing assembly.

3. A breathing apparatus according to claim 1, wherein the connecting pipe has a flange formed integrally at a lower outer periphery thereof, the flange being closely contacted with a lower surface of the floatable body.

4. A breathing apparatus according to claim 3, a O-shaped ring is positioned between the lower surface of the floatable body and the flange so as to firmly seal.

5. A breathing apparatus according to claim 1, wherein the connecting hose is connected to the connecting pipe and the mouth connecting member by cable ties for tightly sealing the connected portions.

6. A breathing apparatus for use in combination with a tube for swimming, the breathing apparatus comprising:

a floatable body having a hollow case for floating over water level and an opening; and a breathing assembly for providing fresh air from the outside to a swimmer's mouth, the breathing assembly having:

a connector having a connecting pipe to be inserted within the opening of the floatable body and a flexible connecting hose having an end portion connected to a lower end portion of the connecting pipe, wherein the connecting pipe has a flange formed integrally at a lower outer periphery, the flange being closely contacted with a lower surface of the floatable body;

a O-shaped ring positioned between the lower surface of the floatable body and the flange so as to firmly seal;

a fixing cap for providing fresh air from the outside to the breathing assembly, the fixing cap being mounted on an upper central portion of the floatable body and removably attached to the connecting pipe to prevent separation of the connecting pipe from the fixing cap, wherein the fixing cap has an upper member and a lower member which may be separated from each other, the lower member of the fixing cap having at least two or more protrusions from a lower outer surface thereof in contact with the upper central portion of the floatable body, at least two or more spaces between the protrusions, and a plurality of holes, said protrusions, spaces, and holes defining a passageway to allow fresh air from the outside into the breathing assembly;

a mouth connecting, member connected to the other end portion of the connecting hose, the mouth connecting member having an air entry portion positioned near the connected portion of the connecting hose and the mouth connecting member, an air exit portion positioned near a lower end portion of the mouth connecting member, and a mouth piece formed integrally with the mouth connecting member, the mouth piece positioned between the air entry portion and the air exit portion, the mouth connecting member providing air from the fixing cap to the swimmer's mouth through the mouth piece;

an air intake check member arranged at the air entry portion, the air intake check member having an inlet check valve opened only in the direction of the air entry to prevent counterflow of exhausted air;

a water intake check member arranged at the air exit portion, the water intake check member having an outlet check valve for discharging exhausted air outside and for preventing entry of water from outside into the breathing assembly, wherein the inlet check valve is opened for breathing in of the swimmer, the outlet check valve is shut for preventing upward flow of exhausted air and entry of water, and when the outlet check valve is opened for discharging exhausted air, the inlet check valve is shut; and a bendable guide hose connected to the air exit portion at the lower end portion of the mouth connecting member, wherein the guide hose is bendable by the swimmer to direct exhausted air away from the swimmer's field of vision.

* * * * *